United States Patent [19]

De Rosa

[11] 3,938,419

[45] Feb. 17, 1976

[54] ELECTRONIC MUSICAL INSTRUMENT

[76] Inventor: David De Rosa, Box 193, West Sand Lake, N.Y. 12196

[22] Filed: May 20, 1974

[21] Appl. No.: 471,288

[52] U.S. Cl. ..... 84/1.14; 84/1.04

[51] Int. Cl.[2] ..... G10H 1/00; G10H 5/00

[58] Field of Search ..... 84/1.01, 1.04, 1.09–1.11, 84/1.14, 1.15, DIG. 14, DIG. 15, DIG. 20, DIG. 21, DIG. 24

[56] References Cited

UNITED STATES PATENTS

| | | | |
|---|---|---|---|
| 2,138,500 | 11/1938 | Miessner | 84/1.11 X |
| 2,301,184 | 11/1942 | Arnold | 84/1.01 |
| 2,868,876 | 1/1959 | Ticchioni | 84/1.04 X |
| 2,873,637 | 2/1959 | Herold | 84/1.04 |
| 2,878,708 | 3/1959 | Hanert | 84/1.14 X |
| 3,429,976 | 2/1969 | Tomcik | 84/1.14 X |
| 3,439,106 | 4/1969 | Goodale | 84/1.09 X |
| 3,506,773 | 4/1970 | George | 84/1.04 X |
| 3,538,804 | 11/1970 | George | 84/1.01 |
| 3,711,617 | 1/1973 | Evans | 84/1.01 |
| 3,767,833 | 10/1973 | Noble et al. | 84/1.01 |
| 3,786,166 | 1/1974 | Mieda | 84/1.01 |

*Primary Examiner*—L. T. Hix
*Assistant Examiner*—Stanley J. Witkowski
*Attorney, Agent, or Firm*—Kane, Dalsimer, Kane, Sullivan and Kurucz

[57] ABSTRACT

A musical wind instrument of the type having a plurality of valves, the opening and closing of which is normally used to control the instrument frequency, is combined with a music synthesizer of the type including a voltage controlled oscillator. The voltage applied to the oscillator is controlled by means connected to the instrument valves so that the applied voltage varies in response to the opening and closing of the valves.

9 Claims, 4 Drawing Figures

ELECTRONIC MUSICAL INSTRUMENT

BACKGROUND OF THE INVENTION

The present invention relates to electronic musical instruments and more particularly to an electronic wind brass instrument such as a trumpet.

Music synthesizers have, for some time, been used with various types of musical instruments such as organs and pianos. The music synthesizer is in effect a voltage controlled oscillator having associated with it a system of filters, and waveform and amplitude shapers used to produce output signals of a frequency corresponding to musical notes. Heretofore, synthesizers have been used primarily with organ type keyboards to control the applied voltage and hence output frequency.

There are many advantages to the use of the synthesizer rather than actual instruments to produce sounds. For instance, a synthesizer may be programmed to automatically produce notes in harmony with the notes being played. Another advantage is that the synthesizer's output is an electronic signal which may be used to drive an amplifier and speaker system for loud volume if required or an earphone arrangement which enables the musical instrument to be played without disturbing others. Similarly, the output of the synthesizer could be connected directly to a tape deck for recording without any audible signal produced until the tape deck is played back.

As stated, up until now, the use of a synthesizer has been limited to musicians having keyboard skills. There are, however, many talented musicians devoted to wind instruments such as the trumpet, cornet, flugelhorn, French horn, etc., who could also benefit from the use of the music synthesizer. Accordingly, it is a principal object of the present invention to provide an apparatus which allows a musician skilled in the use of a valved brass instrument to use his skills to play the music synthesizer.

SUMMARY OF THE INVENTION

The above and other beneficial objects and advantages are attained in accordance with the present invention by combining a music synthesizer of the type including a voltage controlled oscillator with a musical wind instrument of the type having a plurality of valves, the opening and closing of which is normally used to control the instrument frequency. A voltage source is connected to the synthesizer and means are connected to the voltage source and the instrument valves to control the voltage applied to the oscillator in response to the opening and closing of the valves. Means are also provided for altering the output frequency range of the synthesizer in response to the positioning of a multiposition switch which permits half octave shifts in the output frequency of the synthesizer.

DETAILED DESCRIPTION OF THE PREFERRED EMBODIMENT

The following preferred embodiment of the present invention is directed at the use of a music synthesizer with a trumpet. It should be appreciated at the outset, however, that the present invention is not limited to a trumpet and indeed would apply equally to any wind instrument which is played by blowing into an appropriate mouthpiece whether the instrument relies on the air column per se to produce a sound (as with a trumpet) or on the vibrations of a reed to produce the desired sound (as with a clarinet or oboe).

Figure 1:
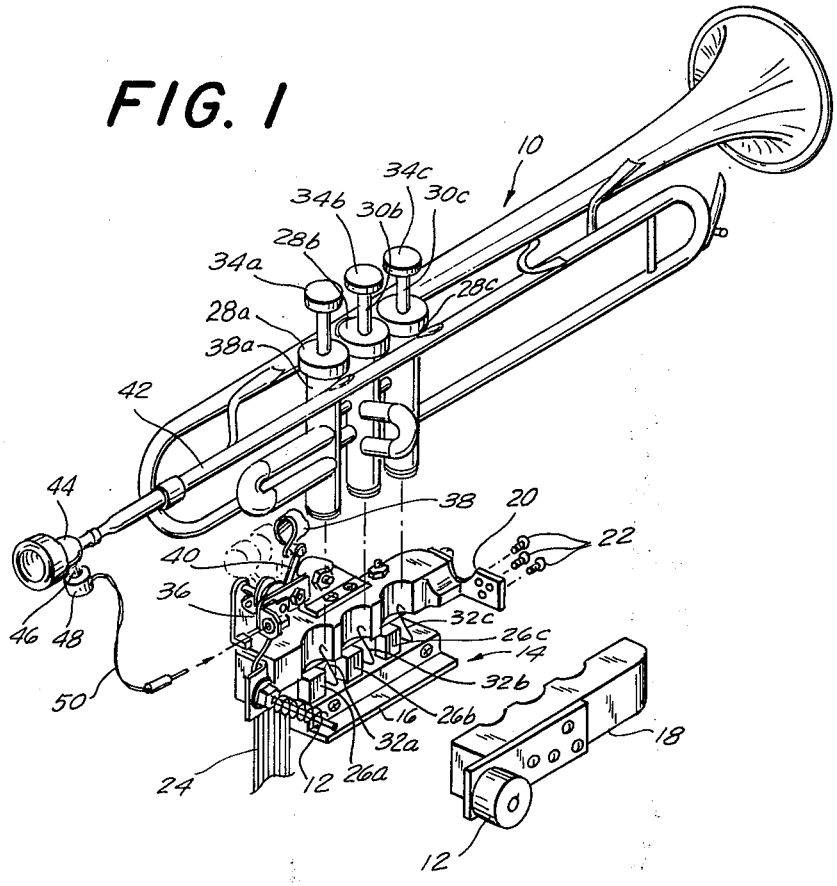
FIG. 1 is a perspective view of an electronic musical instrument in accordance with the present invention; and, FIGS. 2, 3 and 4 are block diagrams showing various portions of the electronic circuitry of the present invention.

Reference is now made to the drawings wherein the electronic musical instrument of the present invention is depicted. In the following description, similar components bear the same reference numeral with differing subscripts wherever possible. Thus, where the following description applies equally to all the different but similar components, the component reference numeral without any subscript will be used in place of repeating the numeral with each of the different subscripts. Thus, for example, when reference is made to "valve 28" it should be understood that the descriptive material applies equally to each of valves 28*a*, 28*b* and 28*c*. In FIG. 1, a conventional trumpet 10 is shown. Attached to the trumpet and secured in place by a clamping screw and bolt arrangement 12 is a mounting block 14 carrying a plurality of switches. The mounting block is formed of two sections 16 and 18 secured together by plate 20 and screws 22. A multi-lead cable 24 extends from the switches for connection with a power source and a commercially obtainable musical synthesizer in a manner that will be described forthwith. In a successful practice of the invention, a synthesizer model 2720-2 available from PAIA Electronics Inc. of Oklahoma City, Oklahoma, was utilized with its associated power supply obtainable from the same source.

As will be noted from FIG. 1, there is a valve switch 26*a*, 26*b*, and 26*c* mounted on block 14 in registry with each valve 28*a*, 28*b* and 28*c* of the trumpet. To this end, mounting block sections 16 and 18 cooperate in defining cutouts to receive the valves 28. In normal use, the bottoms of the trumpet valves 28 are closed by removable caps. With the valve caps removed, the bottom of each of the valve rods 30 becomes exposed and accessible. A linkage, such as rod or pin 32, connects the bottoms of valve rods 30 with the actuating arms of valve switches 26 which preferably are of the quick response mercury or reed type. Thus, as the musician presses down on and releases the trumpet valve keys 34, the associated valve switches 26 close and open. Incidentally, it should be noted that removal of the valve caps does not in any way interfere with the normal operation of the trumpet so that the musician can continue to play his trumpet in a conventional manner, even when the mounting block 14 is attached and connected to the trumpet as described above.

In addition to the valve switches 26, a multiposition switch 36 is also affixed to block 14. The function and operation of this switch will best be understood after the following brief description of the conventional operation of a trumpet.

In normal use, a trumpeter is able to obtain up to 7 notes from his instrument by varying the combination of keys 34 that he depresses. In addition, the range of the instrument can be altered by the musician varying his lip configuration on the mouthpiece of the instrument. A skilled musician, by varying his lip, can obtain four or five ranges of a half octave each with each range consisting of up to seven sequential notes obtainable by varying the pattern of keys depressed.

In accordance with the present invention, the range of the electronic instrument is changed by changing the position of the actuating arm of switch 36. To this end, switch 36 is conveniently placed on the mounting board on the mouthpiece side of the trumpet valves where it may be engaged by the musician's left thumb which is not used during the normal playing of the trumpet. A strap 38 is provided on the arm portion 40 of switch 36 to secure the musician's thumb to the arm. In normal play, the left thumb of the trumpeter merely rests on the trumpet pipe 42 so that the musician loses none of his capability of playing the trumpet in a conventional manner even with his thumb strapped to switch 36.

Figure 2:
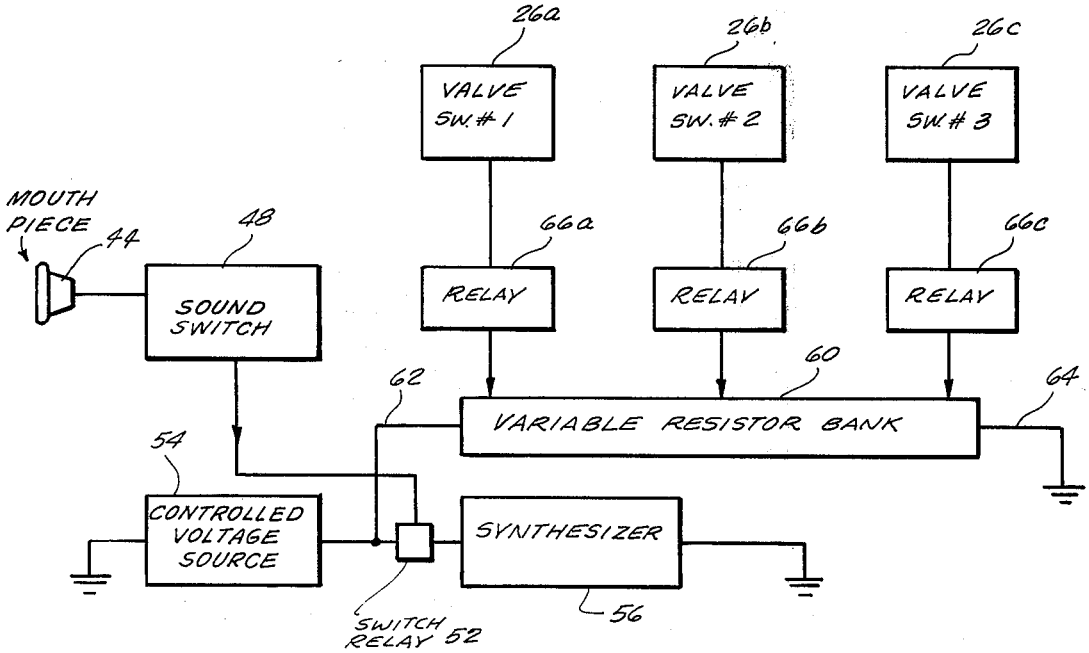

It should be noted that the trumpet mouthpiece 44 is provided with an outlet stem 46. A mouthpiece provided with such an outlet stem is available from several commercial sources and is normally used to connect the trumpet to conventional amplifier systems. In accordance with the present application, the outlet stem 46 is connected to a "breath" actuated switch 48 which, in turn, is connected through a cable 50 to control a relay 52 (see FIG. 2) interconnecting a controlled voltage source 54 with the synthesizer 56 and more particularly to the voltage controlled oscillator of synthesizer 56. The "breath" actuated switch 48 is of the type often used on microphones which automatically closes as soon as air passes over it. Thus, when a musician blows into the mouthpiece of the trumpet (whether or not an actual sound is produced) the switch 48 will be actuated to close relay 52 to apply the controlled voltage output of source 54 to the synthesizer 56.

Figure 3:
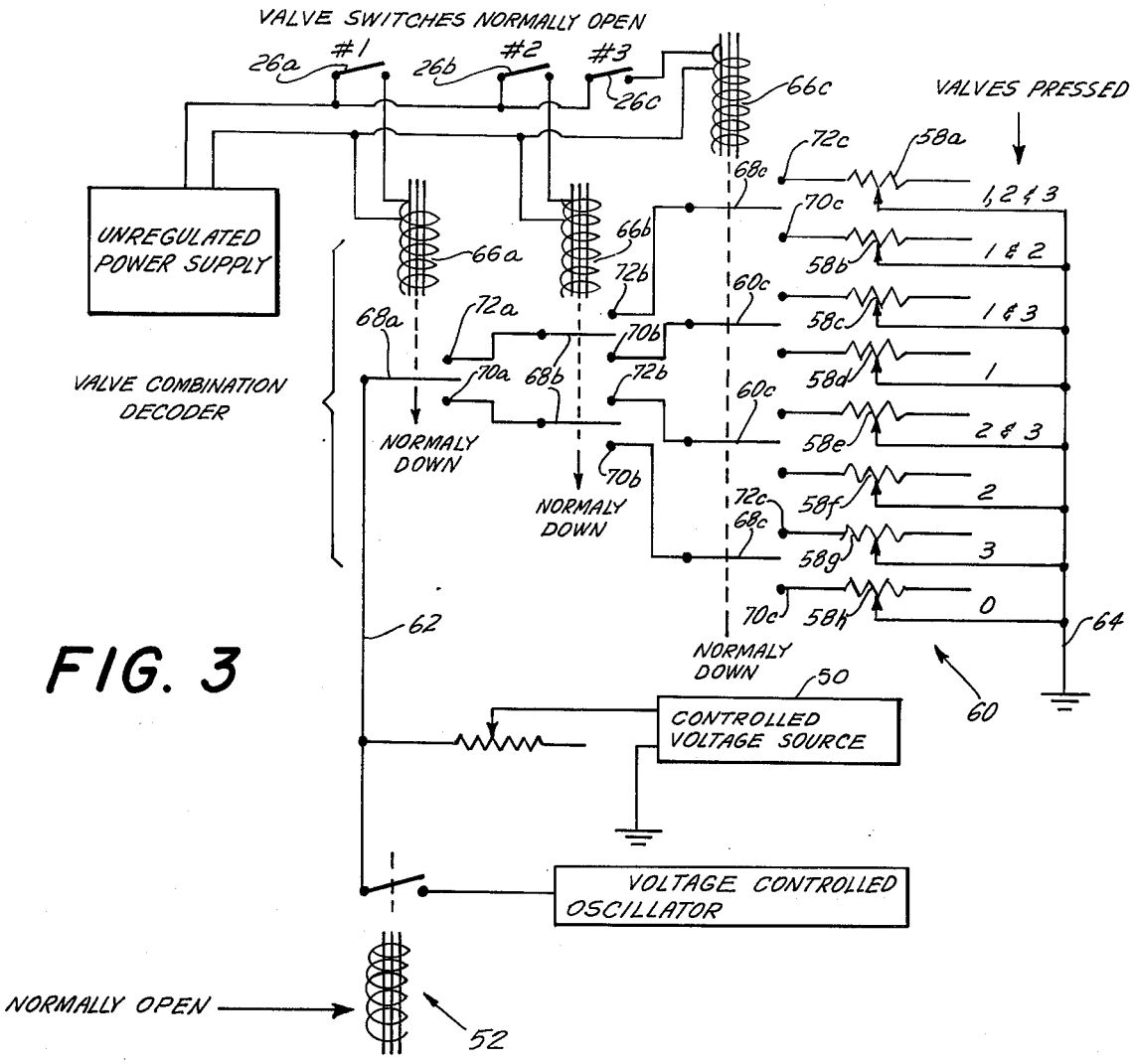

As was previously mentioned, the heart of the electronic synthesizer 56 is a voltage controlled oscillator. That is, an oscillator whose output frequency is related to the magnitude of the driving voltage. In accordance with the present invention, each of the valve associated switches 26 is connected through a relay arrangement to a resistance element 58 as shown in FIG. 3 which, in turn, comprises a portion of a resistance bank 60. The resistance bank 60 extends between a first terminal 62 and a second terminal 64 connected to ground. The total resistance between terminals 62 and 64 depends upon those resistors 58 brought into active connection between the terminals by virtue of their associated valve switches 26 being closed and hence their associated relays 66 being actuated in the manner shown in FIG. 3 and as will be described forthwith.

Terminal 62 of the resistance bank 60 is connected to the juncture of the controlled voltage source 50 and synthesizer 56 so that the resistance bank 60 is connected in parallel with the synthesizer. Thus, as should be apparent, the voltage to the synthesizer 56 varies with the resistance of bank 60 and accordingly the frequency or pitch of the musical output of the synthesizer can be varied by properly depressing the trumpet keys 34 to vary the resistance of the bank. By properly choosing the values of the resistance elements 58, the output of the synthesizer will be a series of sequential notes obtained by depressing valve keys 34 in the same sequential manner as if the musician wanted to obtain the same run of sequential notes by playing the trumpet in a conventional way.

In order to obtain the desired range of values for resistance bank 60, each of the valve switches 26 is connected to a relay 66 having appropriate sets of contacts to make the required connections as shown in FIG. 3. Thus, when trumpet key **34*a* is depressed, switch 26*a* is closed so that relay contact arm 68*a* is lifted from its normally down position engaging the lower contact 70*a* to a raised position engaging the upper contact 72*a*. As a result, resistor 58*d* is connected between the terminals 62 and 64. Similarly, when the second trumpet key 34*b* is depressed relay arms 68*b* are lifted from their lower contacts 70*b* to engage their upper contacts 72*b* and when the third key 34*c* is depressed relay arms 68*c* are lifted from their lower contacts 70*c* to engage their upper contacts 72*c*. When trumpet keys 34*a* and 34*b* are both depressed, resistor 58*b* is connected between terminals 62 and 64 and so on as indicated on FIG. 3. As previously stated, relay 52 controls the connection between the controlled voltage 54 and synthesizer 56 so that the output of the controlled voltage source 54** is only applied to the synthesizer when the musician is blowing into his trumpet.

Figure 4:
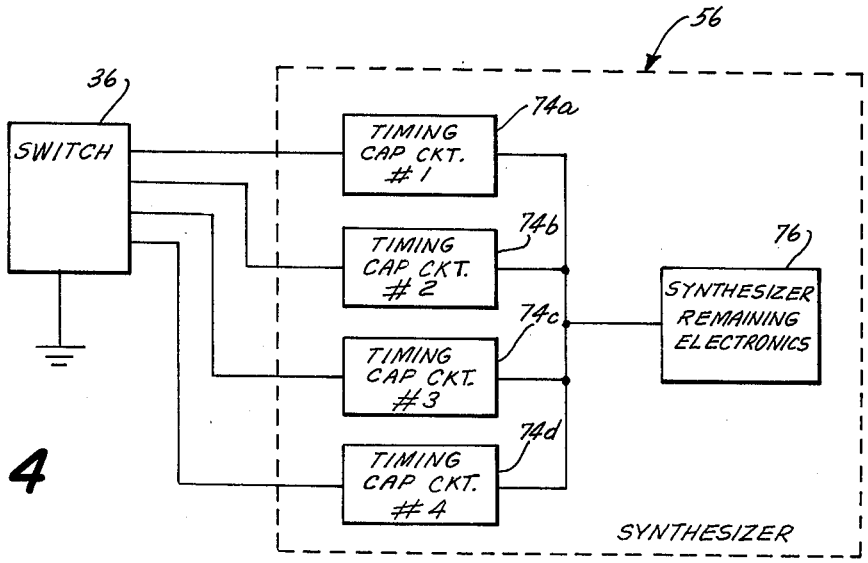

The frequency range of the output of synthesizer 56 is governed by the value of an RC circuit within the synthesizer 56 and particularly the value of the synthesizer timing capacitor. Referring to FIG. 4, it can be seen that the thumb operated switch 36 serves to interconnect one of the several timing capacitor circuits **74*a*, 74*b*, 74*c* or 74*d* with the remaining electronics 76 of the synthesizer 56. The particular timing capacitor circuit 74 connected to the remaining electronics is determined by the position of switch 36. The value of the timing capacitor circuits 74 are chosen so as to enable the musician to obtain sequential sections of the chromatic run by varying the position of the switch. Thus, the position of the multi-contact switch 36 determines the range of the synthesizer 56 with the particular note (within the range) being determined by the value of the resistance bank 60** which, in turn, is governed by the particular keys of the trumpet that are depressed by the musician.

In operation, the musician turns on the unregulated power source which provides current for the relays 52 and 66 as well as an input to the controlled voltage source 54. The musician then either plays the trumpet in the usual manner thereby producing the usual trumpet sounds from the instrument or merely blows in the trumpet so as to produce no sound directly from the trumpet. In either event, the musician's breath actuates switch 48 as a result of which relay 52 is energized thereby connecting the output of the controlled voltage source 54 with the synthesizer 56. The fingering of the trumpet keys 34 (and therefore the opening and closing of valve switches 26) regulates the voltage applied to the synthesizer. This, in combination with the positioning of switch 36 which determines the timing capacitor circuit 74 of the synthesizer and hence the range of the synthesizer output results in a desired musical note being produced by the synthesizer. That note may or may not be the same as the note produced through the trumpet (if any note is produced through the trumpet). If the musician desires, the synthesizer may be connected to a speaker system to enable an audience to hear him play. Alternately, the synthesizer could be connected to earphones to enable him to practice in privacy or to a recording device for later playback. Thus, in accordance with the above, the aforementioned objects are attained. It should be realized that certain modifications could be made in my invention without departing from the scope of the invention as defined by the following claims. For example, the various relays 52 and 66 could be replaced with other types of switching devices to obtain the same end result. Also, in place of a complete trumpet, a mouth piece, valves and synthesizer could be utilized along with the controls described above.

What is claimed is:

1. In combination: a music synthesizer of the type including a voltage controlled oscillator to produce an output signal of a frequency determined by the voltage applied thereto, the frequency range of said output signal being controlled by the value of a capacitance circuit comprising a portion of said synthesizer;

a musical wind instrument of the type having a plurality of valves, the opening and closing of which is normally used to control the frequency of the note produced by said instrument when said instrument is played in a conventional manner; a voltage source connected to said synthesizer; means connected to said voltage source and said valves to control the voltage applied to said oscillator in response to the opening and closing of said valves;

a plurality of capacitance circuits, the value of each of said circuits being such as to produce a different frequency range for said synthesizer when interconnected to form said portion of said synthesizer; and multiposition switch means interconnecting said plurality of capacitance circuits with said synthesizer whereby in each position of said switch a different capacitance circuit is interconnected with said synthesizer to comprise said portion of said synthesizer.

2. The invention in accordance with claim 1 wherein said control means includes a variable resistor comprising a plurality of resistance elements, first and second terminals of said variable resistor, and switch means operatively connected to each of the valves of said plurality of valves to selectively connect said resistance elements to said terminals in response to the opening and closing of said valves.

3. The invention in accordance with claim 2 wherein said variable resistor and synthesizer are connected in parallel to said voltage source.

4. The invention in accordance with claim 1 wherein said instrument includes a mouthpiece, switch means capable of being activated by the blowing of air into said mouthpiece connected to said mouthpiece, and circuit means actuated by said aforementioned switch means interconnecting said voltage source with said oscillator whereby the output of said voltage source is connected to said oscillator when said aforementioned switch means is activated.

5. The invention in accordance with claim 1 wherein said multiposition switch means is mounted to said instrument.

6. The invention in accordance with claim 1 wherein the values of said capacitance circuits is such that the output range of said synthesizer with each of said capacitance circuits is one half an octave.

7. The invention in accordance with claim 6 comprising at least four capacitance circuits connected to form adjacent positions of said multiposition switch means and the values of said capacitance circuits is such as to produce sequential half octave ranges for the output frequency of said synthesizer.

8. The invention in accordance with claim 1 wherein said instrument comprises a trumpet.

9. The invention in accordance with claim 8 wherein said multiposition switch is mounted to said trumpet on the mouthpiece side of the trumpet valves in position for engagement by the left thumb of a player of the trumpet.

* * * * *